United States Patent [19]

Corsette

[11] 4,410,107

[45] Oct. 18, 1983

[54] LIQUID DISPENSING PUMP

[76] Inventor: Douglas F. Corsette, 6559 Firebrand St., Los Angeles, Calif. 90045

[21] Appl. No.: 332,338

[22] Filed: Dec. 18, 1981

[51] Int. Cl.[3] ..... B65D 88/54

[52] U.S. Cl. ..... 222/321; 222/380

[58] Field of Search ..... 222/320, 321, 372, 375, 222/380–385; 239/333; 417/550, 566

[56] References Cited

U.S. PATENT DOCUMENTS

| | | | |
|---|---|---|---|
| 2,956,509 | 10/1960 | Cooprider et al. . | |
| 3,282,472 | 11/1966 | Roder | 222/321 |
| 3,507,586 | 4/1970 | Gronemeyer et al. . | |
| 3,527,551 | 9/1970 | Kutik et al. . | |
| 3,759,426 | 9/1973 | Kane et al. . | |
| 3,797,705 | 3/1974 | Cooprider . | |
| 3,827,605 | 8/1974 | Knickerbocker . | |
| 3,827,606 | 8/1974 | Knickerbocker . | |
| 4,046,495 | 9/1977 | Grimm . | |
| 4,050,613 | 9/1977 | Corsette . | |
| 4,057,176 | 11/1977 | Horvath | 222/321 X |
| 4,079,865 | 3/1978 | Kutik . | |
| 4,218,198 | 8/1980 | Kutik et al. . | |
| 4,305,702 | 12/1981 | Hartley | 417/566 X |

*Primary Examiner*—Joseph J. Rolla
*Assistant Examiner*—Thomas Fitzgerald
*Attorney, Agent, or Firm*—Watson, Cole, Grindle & Watson

[57] ABSTRACT

Discharge valving for a liquid dispensing pump having a reciprocable plunger is in the form of a laterally extending bunsen valve having an annular spring washer which resiliently bears against an annular valve seat adjacent the discharge opening. The loading of the valve is controlled by valve positioning lugs between the top of the plunger and an overlying plunger head. The plunger may be immobilized in a fully raised position above the pump body or in a fully depressed position relative to the pump body by locking fingers positively deflected into and out of the path of reciprocation of a stop shoulder on the plunger head.

9 Claims, 8 Drawing Figures

LIQUID DISPENSING PUMP

RELATED APPLICATION

This application relates to my copending application Ser. No. 121,001, filed Feb. 13, 1980 now U.S. Pat. No. 4,343,417.

BACKGROUND OF THE INVENTION

This invention relates generally to a finger operated liquid dispensing pump of the hand-held variety; and more particularly to such a pump having an improved discharge valve. Additional features include means for selectively locking the plunger in a fully depressed position and means for selectively immobilizing the pump plunger in a fully raised position.

Dispensers of the general class to which the present invention is directed have included discharge valving in the form of annular flaps or sleeves which are resiliently flexible for opening the discharge passage in response to an axial flow of pressurized liquid applied during the plunger pressure stroke. The discharge passages normally open as the flap bends or flexes radially inwardly, or the sealing flange or sleeve expands circumferentially in response to positive pressure. In either case, the hoop ring forces at the circular edges of such valves must be overcome for opening the discharge. However, it is difficult to predict and devise an appropriate hoop strength which must be overcome for the dispensing of different products having different flow characteristics. Moreover, these known valves rely on their inherent resiliency which self biases the circular sealing edge against the valve seat for controlling the discharge passage. Thus, it is most difficult if not impossible to adjust this self biased pressure to control the loading of the valve, without substituting a different valve flap or sleeve.

Moreover, different approaches have been taken for immobilizing the plunger during a non-use condition of shipping and/or storage. One such approach is disclosed in U.S. Pat. No. 3,527,551 for locking the plunger in a fully depressed position as lugs on the outside of the plunger engage beneath lips projecting inwardly from a housing in which the plunger reciprocates. Lock-down is effected upon rotation of the plunger after it is fully depressed. It would, however, be desireable to provide a more positive plunger lock-down to avoid any inadvertant unlocking of the plunger while at the same time effecting a positive seal against leakage of product from the container through the container vent opening during plunger lock-down.

Other approaches have been taken, including that disclosed in the aforementioned related application, for immobilizing the plunger in a fully raised position above the pump body.

SUMMARY OF THE INVENTION

It is therefore an object of the present invention to provide a dispensing pump having an improved discharge valve which is not only more reliable and effective in controlling the product discharge, but is capable of being sufficiently loaded against its valve seat to effectively resist leakage during storage and shipment.

Another object of the invention is to provide such discharge valving in the form of an annular, so-called bunsen valve extending in a lateral direction and including spring washer having a resilient hinge to facilitate valve opening during the plunger pressure stroke.

A further object of the invention is to provide a dispensing pump having a reciprocable plunger capable of being locked into a fully depressed position on the pump body in a manner in which any tendency to inadvertantly unlock the plunger is prevented, while any interference while unlocked is avoided during plunger reciprocation.

A still further object of the present invention is to provide such a lock-down feature as including opposed locking and unlocking cams on the pump body in engagement with locking fingers for laterally deflecting same.

The annular bunsen valve according to the invention comprises a laterally extending spring washer seated against a laterally extending valve seat on the inner surface of the plunger head, an annular resilient hinge at the root end of the washer permitting it to yield upon an increase of pump chamber pressure during the plunger compression stroke. The loading of the valve is controlled by valve positioning lugs which set the relative outward movement of the plunger to thereby set the bearing pressure of the washer against its valve seat. The resilient hinge is formed by a simple annular groove provided at the root end of the valve.

And, another feature of the invention includes the provision of selective plunger lock-down for a dispensing pump by means of a rotatable control ring which functions as a shroud for the dispenser as well as the means for arresting upward movement of the plunger in its fully raised position. The ring includes a plurality of locking fingers having downwardly facing stop shoulders at a common level around the plunger for engagement with an upwardly facing stop shoulder located at the plunger lower end. Opposed locking and unlocking cams on the pump body engage opposing surfaces of each of the locking fingers for positively deflecting the fingers including their stop shoulders transversely into as well as out of the path of the stop shoulder on the plunger. An annular seal ring may be provided on the pump body outwardly of the container vent opening for engagement with a surface of the plunger in its lock-down position to thereby prevent leakage of product from the container through the vent.

Other objects, advantages and novel features of the present invention will become more apparent the following detailed description of the invention when taken in conjunction with the accompanying drawings.

DETAILED DESCRIPTION OF THE INVENTION

Figure 1:
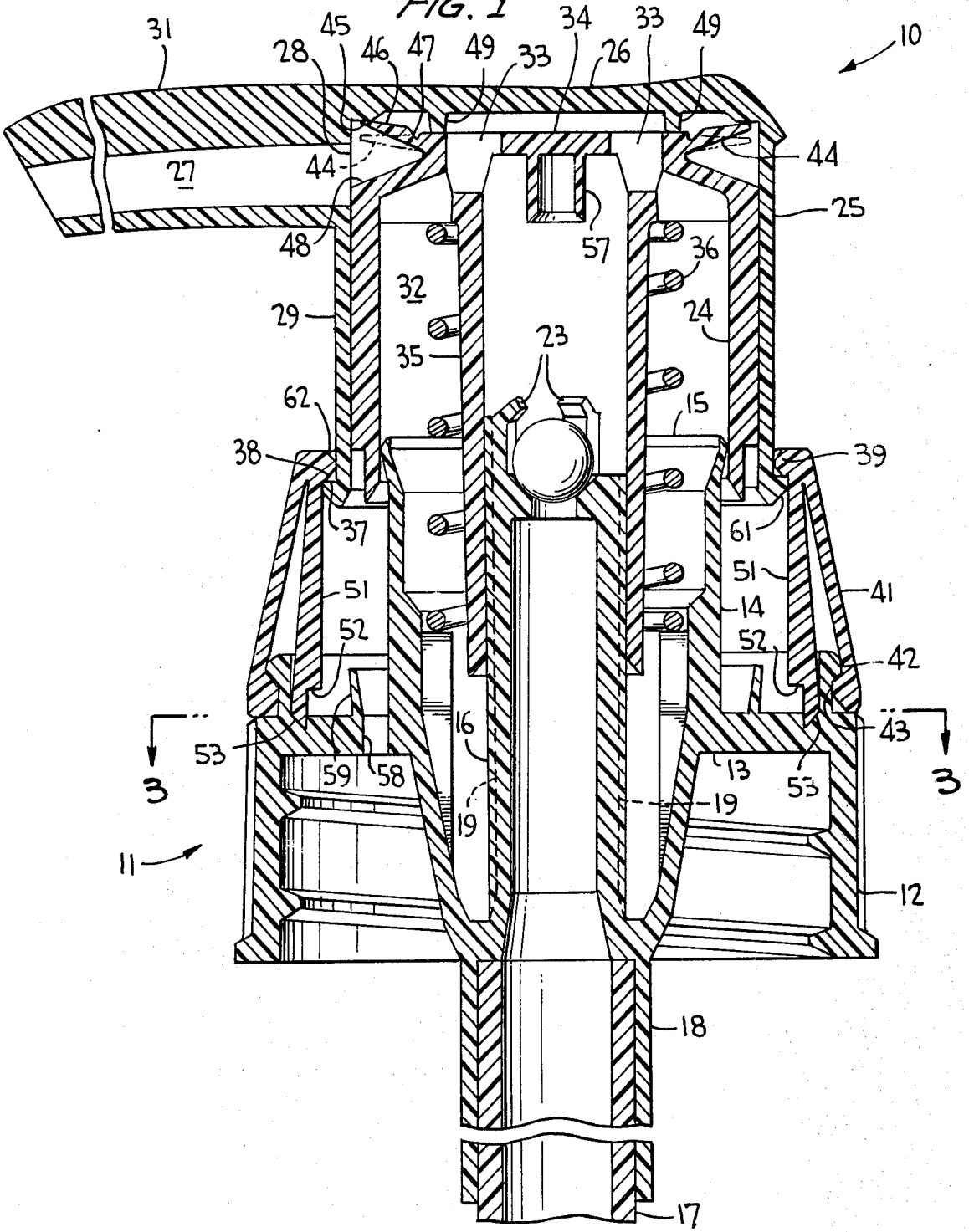
FIG. 1 is a vertical sectional view taken substantially along the line 1—1 of FIG. 3 of the dispensing pump embodying the present invention and showing the pump in readiness for dispensing in its fully raised position.

Turning now to the drawings wherein like reference characters refer to like and corresponding parts throughout the several views, a liquid dispensing pump, generally designated 10, is shown in FIG. 1 which resembles my earlier pump disclosed in the aforementioned related application except that the present pump is not essentially of the pressure build-up variety. Instead, pump 10 of the present invention is of the throttle-type in which the discharge is made to open directly upon an increase in pump chamber pressure.

Pump 10 comprises a pump body member 11 adapted to be secured for fluid tight communication with the opening of a container (not shown) of flowable product to be dispensed, an internally threaded cap 12 being provided for this purpose. A top wall 13 of the cap supports an upstanding cylindrical piston 14 which terminates in a piston lip seal 15. Top wall 13 likewise supports an upstanding hollow post 16 in open communication with a dip tube 17 which extends into the container in the usual manner, the upper end of the dip tube tightly fitting within a sleeve 18 depending from the lower end of the cap. Post 16 lies inwardly of and concentric to the piston and is provided with a plurality of longitudinal grooves 19 on its outer surface for a purpose which will be made more clear hereinafter. And, the upper end of post 16 terminates in an inlet valve seat 21 against which a ball check valve 22 is fully seated during the plunger compression stroke for closing the inlet during the dispensing operation. Ball retention fingers 23 extend from the upper end of the post for capturing the ball check valve during the suction or fill mode of the dispensing operation.

A plunger 24, in the form of a downwardly opening cup, is slideably mounted for reciprocation over the upper end of the piston. A plunger head 25 overlies the plunger and is conformed to present an upwardly directed finger piece 26 by which intermittent finger pressure may be conveniently applied to the head to be transmitted to the plunger for producing reciprocation thereof on piston 14. The plunger is snugly received within the plunger head but is capable of relative movement for a purpose to be seen more clearly hereinafter.

A discharge passage 27 in the plunger head has a discharge opening 28 located in a depending skirt 29 of the head and extending through a discharge spout 31 which communicates with the atmosphere. Relative movement between the plunger and the piston defines a variable volume pump chamber 32 with which the discharge passage communicates via openings 33 in upper wall 34 of the plunger, these openings extending through the upper end of a sleeve 35 depending from wall 34. This sleeve embraces post 16 and slides therealong during piston reciprocation, and provides some stability for the plunger during the dispensing operation in opposition to and the return by a return spring 36 acting between the plunger and the piston. Grooves 19 enhance the filling of the pump chamber with product during the fill mode of operation.

Therefore, at the commencement of the priming and/or pumping operation, spring 36 maintains the plunger in its fully raised position of FIG. 1, the head being held against upward displacement by the interengagement of annular stop shoulders 37 and 38. Shoulder 38 is formed on an annular lug 39 projecting inwardly of a control member of ring 41 secured to the pump body member for relative rotary movement by means of cooperating annular lugs 42 and 43, respectively provided on the members.

The discharge valving according to the invention comprises an annular spring washer or flap 44 extending outwardly of upper wall 34 in a lateral direction relative to the axis of plunger reciprocation. An annular valve seat 45 is provided at the undersurface of the plunger head adjacent discharge opening 28. The spring washer functions as a bunsen valve which is self biased against valve seat 45 at its upper surface 46 in direct communication with pump chamber via openings 33. The root end of the valve is constricted by the provision of an annular groove 47 which defines a resilient hinge along which the valve moves, as shown in phantom outline in FIG. 2, during the plunger compression stroke. The upper surface of the plunger slopes downwardly and outwardly as at 48 to avoid any interference during a discharge opening condition.

Thus, assuming that the pump is primed, a downward stroke of the plunger head closes the inlet and effects an increase in pressure within the pump chamber so that liquid moves laterally from the pump chamber against surface 46 of the discharge valve causing washer 44 to move slightly away from its seat, thus allowing liquid to flow through opening 28 and out of the discharge spout. It should be noted that the outer diameter of flap 44 is slightly less than the inner diameter of plunger head skirt 29 to avoid interference during discharge opening and closing, and to provide a 360° peripheral flow passage from above flap 44 to below flap 44 and to provide a 3,600 peripheral flow passage from above flap 44 to below flap 44.

And, lateral spring washer 44 has its own elastic memory assuring a tight and leakproof seal during each suction stroke and during non-use. Nevertheless, the loading of the discharge valve may need to be controlled to assure resistance against leakage during shipping and storage. For this purpose, valve positioning lugs 49 of a predetermined extent are provided on the undersurface of the plunger head, or alternatively on the upper surface of the plunger. Upper wall 34 of the plunger strikes against these lugs at the end of the plunger upstroke, as shown in FIG. 1. Thus, for lugs 49 having a relatively shorter extent than shown, it can be seen that spring washer 44 would be induced with a heavier bearing pressure as it assumes a flatter diposition upon valve closing. The converse is true for lugs having a relatively longer extent. These lugs act as bearing blocks in opposition to the force of spring 36 and effectively limit the outer extent of the plunger during its return stroke. Thus, for different applications and needs, plunger heads having suitably sized lugs may be chosen without the need for substituting any other part of the apparatus.

Figure 2:
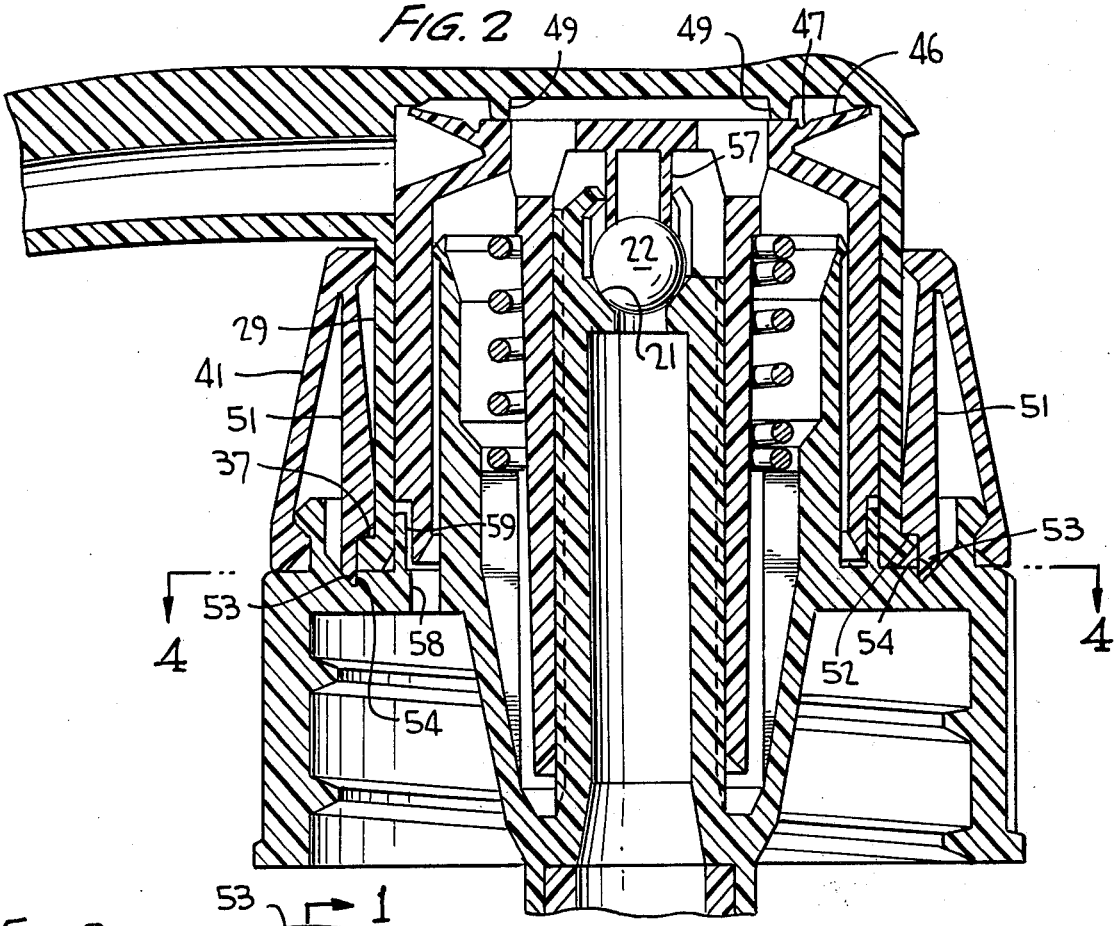
FIG. 2 is a view similar to FIG. 1, taken substantially along the line 2—2 of FIG. 4, with the pump shown in its lock-down position.
Figure 3:
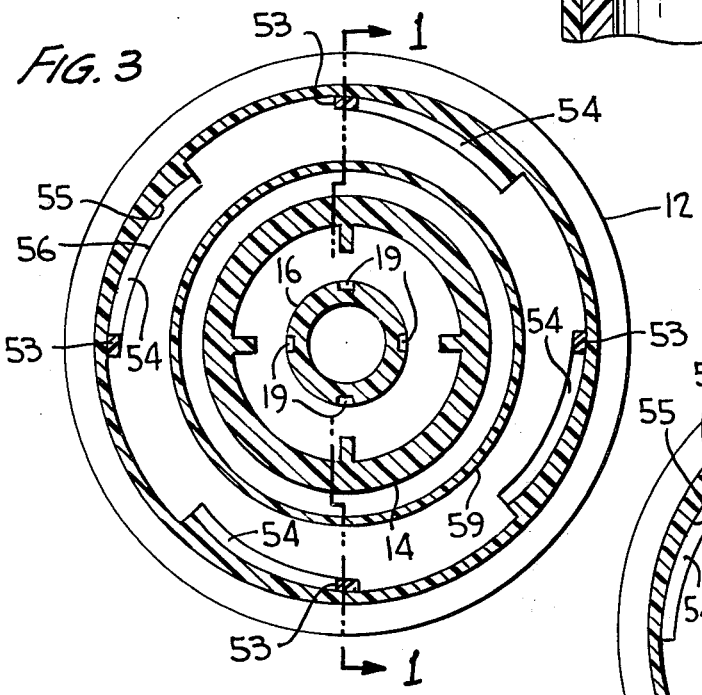
FIGS. 3 and 4 are cross-sectional views respectively taken along the lines 3—3 and 4—4 of FIGS. 1 and 2.

Another aspect of the invention relates to the lockdown of the plunger in its fully depressed position of FIG. 2. For this purpose, a plurality of locking fingers 51 are secured to control member 41 and depend from an upper end thereof in an upright position. Downwardly facing stop shoulders 52 are located adjacent lower ends 53 thereof and lie in a common plane around the plunger. Cam grooves 54 (FIGS. 3 and 4) are provided in the upper surface of wall 13 for each of the locking fingers of which there are four in number in the example disclosed, although any reasonable number exceeding one may be provided. Each cam groove comprises an opposed pair of cam surfaces 55 and 56 for respectively locking and unlocking the plunger upon rotary movement of the control member as the locking fingers are positively deflected, together with their stop shoulders, transversely into as well as out of the path of stop shoulder 37. Thus, with the plunger depressed into its lowermost position of FIG. 2, with ends 53 of the locking fingers lying in the FIGS. 1 and 3 positions, relative rotary movement of members 41 and 11 deflects the locking fingers transversely into their FIGS. 2 and 4 positions in which shoulders 37 and 52 interengage for positively locking down the plunger. With such an arrangement, it can be seen that any tendency to inadvertently unlock the plunger head is prevented and any interference between the head and the locking fingers during plunger reciprocation is avoided.

And, when the plunger is fully depressed and in its immobilized position of FIG. 2, a probe 57, depending from upper wall 34, engages and forces ball valve 22 against its seat 21, and the ball valve will thus coact with both seat 21 and the free end of probe 57 to close off the passage of liquid through the inlet. Such a known feature is disclosed in U.S. Pat. No. 2,956,509.

The pump body also includes a container vent opening 58 for admitting air into the container to replace product after each dispensing stroke to prevent hydraulic lock within the container. To avoid leakage of product through this vent during the immobilized and non-use condition of FIG. 2, an annular upstanding lip seal 59 is provided on top wall 13 and is biased slightly outwardly so as to bear tightly against the inner surface of plunger head 25. It can be therefore seen that the vent, inlet and discharge opening are all tightly sealed against leakage in the FIG. 2 pump condition.

Another feature of the invention includes the provision of mating beveled surfaces 61 and 62 respectively on the plunger head skirt and at the upper end of the control ring, surface 61 sloping upwardly and outwardly relative to the axis of reciprocation, and surfaces 62 sloping downwardly and inwardly relative to such axis. Thus, after the container is filled with product, the pump control ring may then be rotated from its FIG. 1 to its FIG. 2 position so as to transversely deflect the locking fingers inwardly toward the piston. The plunger may then be depressed downwardly over the piston so that shoulders 38 snap behind shoulders 52 into an immobilized position. The pump is thus made ready to be shipped to the customer.

Figure 7:
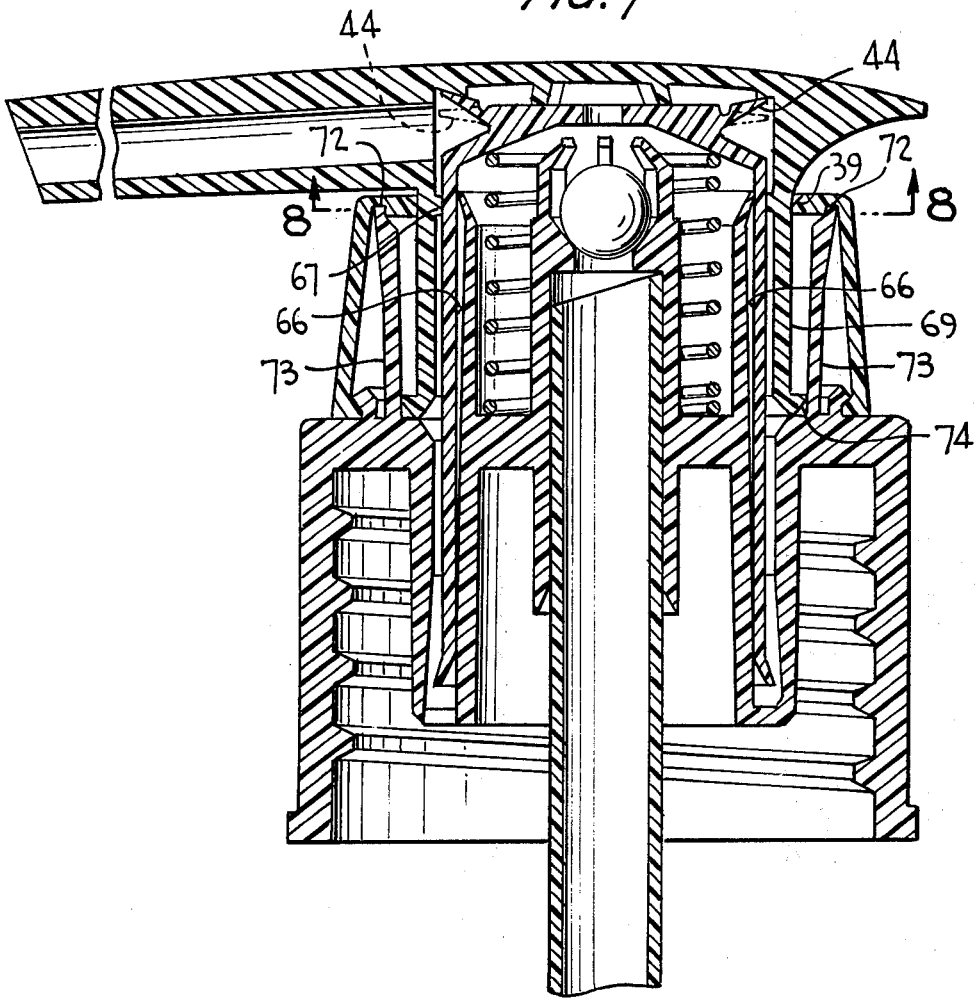
FIG. 7 is a vertical sectional view similar to FIG. 5 but shown with the plunger at the end of its dispensing downstroke.
Figure 8:
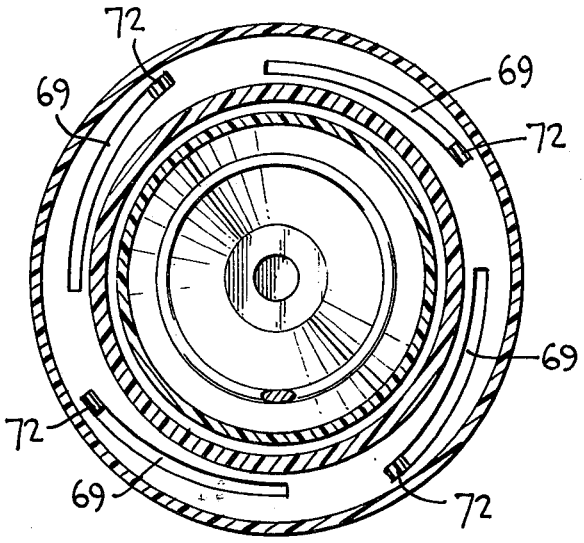
FIG. 8 is a cross-sectional view taken substantially along the line 8—8 of FIG. 7.

The FIG. 5 pump 10A has the same discharge valving as described with reference to FIG. 1 and is constructed essentially the same as the pump 10 so that a detailed description need not be repeated. Pump 10A nevertheless differs in some respects by the provision of a plunger 24 having a long skirt terminating in an annular lip seal 63 which slides along a wall 64 depending from top wall 13 of the container cap. Wall 64 is cylindrical at its upper portion so that a vent chamber 65, defined by the space between wall 64 and the piston in open communication with the interior of the container via a container vent opening 58*a*, remains closed to the atmosphere by lip seal 63 while in contact with this upper portion at the initial stages of the plunger downstroke. Wall 64 extends gradually outwardly at its lower portion as at 64*a* so that a gradually increasing annular gap is formed between lip seal 63 and this lower portion as the plunger approaches the end of its downstroke as shown in FIG. 7. As the lip seal becomes juxtaposed to wall portion 64*a*, the container communicates with the atmosphere through a vent passage which extends through vent 58*a*, between wall 64 and the plunger, and outwardly of the pump through the non-sealed engagement between lugs 39 and plunger skirt 29. Such a venting arrangement is disclosed in my copending application Ser. No. 121,223, filed Feb. 13, 1980.

Figure 5:
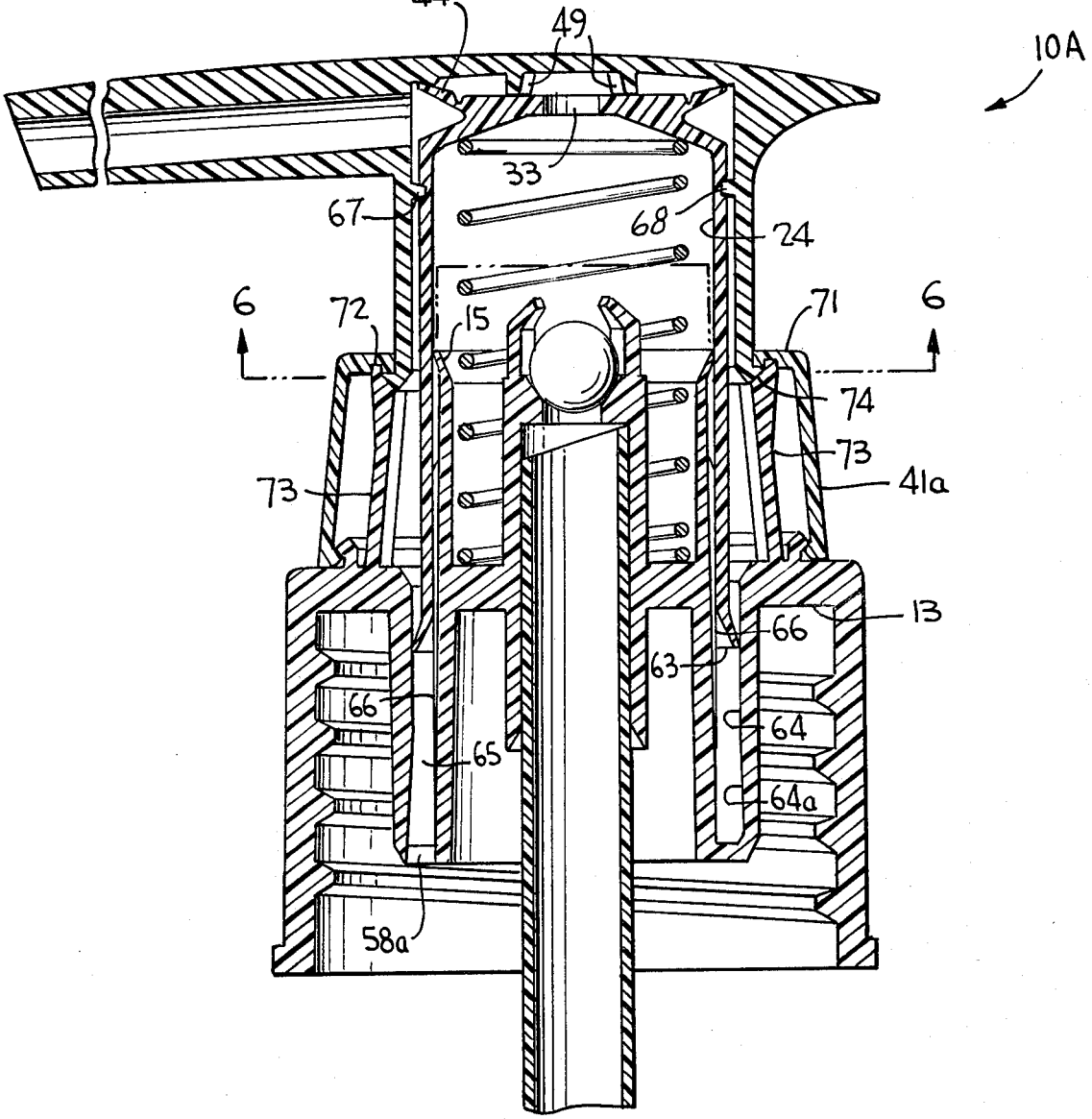
FIG. 5 is a vertical sectional view taken through a dispensing pump embodying the invention but shown in a lock-up position.
Figure 6:
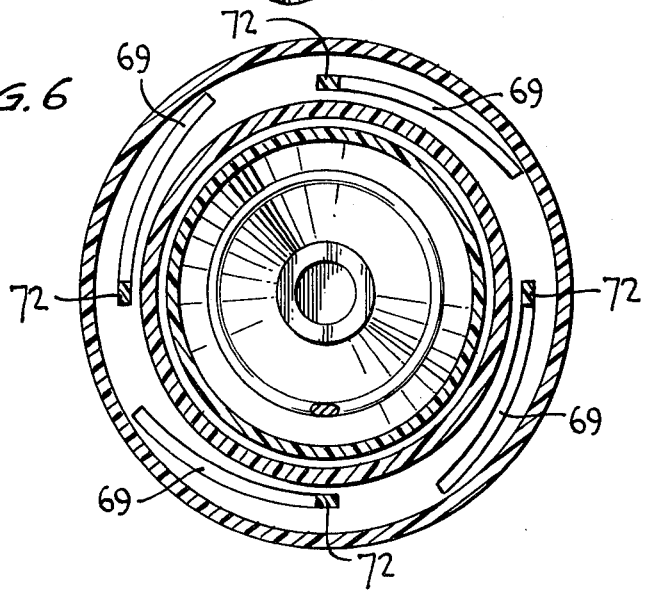
FIG. 6 is a cross-sectional view taken substantially along the line 6—6 of FIG. 5.

Also provided in the FIG. 5 embodiment are a plurality of longitudinally extending ribs 66 spaced along the outer surface of plunger 24, and tapering inwardly from top to bottom. These ribs function as low-friction guide means between the plunger and the piston wall during plunger reciprocation. Furthermore, an annular packing gland 67 is provided between the plunger and the plunger head and is retained in place within an annular groove 68 on the plunger. This packing gland provides a seal between the plunger and the head yet facilitates relative shifting movement of the plunger upon assembly of a different plunger head having different positioning lugs 49 as for the purpose described with reference to FIG. 1. Also, such a packing gland may be provided in the FIG. 1 pump in lieu of the snug engagement between plunger 24 and skirt 29.

Figure 4:
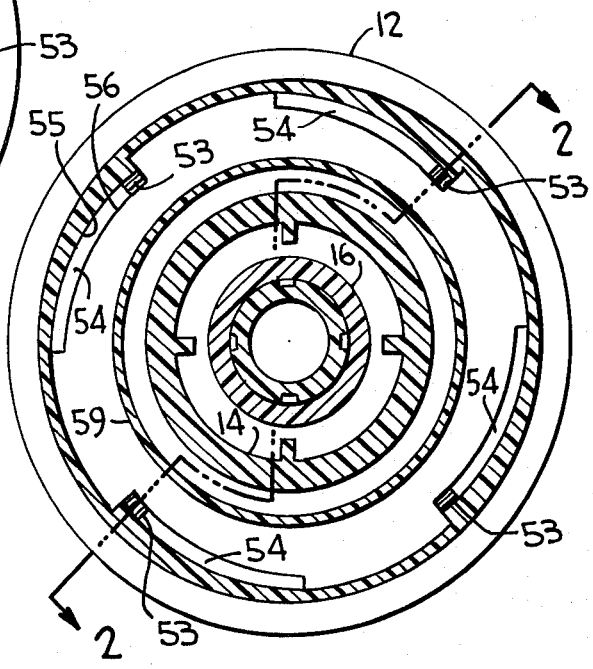

Yet another difference between dispenser 10 and 10A is that the plunger of the latter is immobilized in a fully raised position above the pump body, similarly as disclosed in FIGS. 4 and 5 of the aforementioned related application. Such disclosure is therefore hereby specifically incorporated into the present application. Briefly, control member 41*a* is provided with a plurality of cam grooves 69 at the undersurface of its upper wall 71. Upper ends 72 of locking fingers 73 respectively engage these cam grooves so as to be thereby deflected transversely to the axis of reciprocation into and out of the path of reciprocation of a downwardly facing stop shoulder 74 on the plunger head. The plunger is shown immobilizied in a fully raised position in FIG. 5, and is shown in FIG. 7 after the locking fingers have been deflected outwardly to permit plunger reciprocation.

Obviously, many other modifications and variations of the present invention are made possible in the light of the above teachings. It is to be therefore understood that within the scope of the appended claims the invention may be practiced otherwise than as specifically described.

What is claimed is:

1. In a pump for dispensing fluid from a container, including a variable volume pump chamber defined by relative movement between piston and cylinder members along an axis of reciprocation, said chamber having a valve controlled inlet passage, a discharge passage extending from said chamber, a discharge valve for said discharge passage, the pumping of fluid from said pump chamber through said discharge passage being effected upon relative movement between said members against the force of a return spring acting therebetween, said spring urging relative outward movement between said members for suctioning fluid into said chamber through said inlet passage, said discharge passage extending from said pump chamber in a lateral direction relative to said axis of reciprocation, the improvement wherein said discharge valve comprises a valve seat and a spring washer both extending in said lateral direction, said spring washer being hingedly connected to one of said members for resilient engagement against said valve seat in a discharge closing position, and said return spring urging said discharge valve into said closing position.

2. In the pump according to claim 1, the improvement further comprising means in engagement with said one member for setting the relative outward movement between said members to thereby control the bearing pressure of said spring washer against said valve seat.

3. In the pump according to claim 2, wherein said member comprises a reciprocable plunger, a plunger head on said plunger, and said head including said discharge passage, said valve seat and said control means.

4. In the pump according to claim 3, wherein said control means comprise a plurality of lugs engaging an outer surface of said plunger.

5. A dispensing pump comprising, a pump body having a fixed piston thereon, an annular plunger mounted for reciprocation on said piston to therewith define a variable volume pump chamber, a valve controlled inlet passage extending into said chamber through said piston, a plunger spring urging movement of said plunger into its suction stroke, a plunger head on said plunger, said head including a discharge passage extending from said pump chamber, an annular valve seat adjacent said discharge passage, said valve seat extending in a lateral direction to the axis of reciprocation of said plunger and lying on an inner surface of said head, a discharge valve on said plunger comprising an annular spring washer having an annular resilient hinge along which said discharge valve is secured to said plunger, said spring washer extending outwardly from said plunger in said lateral direction and resiliently engaging said valve seat in a discharge closing position at the end of said suction stroke, said plunger spring urging said ring into said closing position.

6. The pump according to claim 5, wherein means are provided between said plunger and said head for setting the extent of said suction stroke to thereby set the bearing pressure of said ring against said valve seat.

7. The pump according to claim 6, wherein said setting means comprises a plurality of lugs on said head in engagement with an outer surface of said plunger.

8. The pump according to claim 5, wherein said hinge between said spring washer and said plunger comprises an annular groove for effecting a valve opening movement away from said head and said valve seat during the plunger pressure stroke.

9. The pump according to claim 5, wherein an outer surface of said spring washer engages said valve seat in said discharge closing position.

* * * * *